US007263194B2

(12) United States Patent
Niederdränk et al.

(10) Patent No.: US 7,263,194 B2
(45) Date of Patent: Aug. 28, 2007

(54) HEARING DEVICE

(75) Inventors: Torsten Niederdränk, Erlangen (DE); Christian Weistenhöfer, Bubenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 10/944,600

(22) Filed: Sep. 17, 2004

(65) Prior Publication Data

US 2005/0105749 A1 May 19, 2005

(30) Foreign Application Priority Data

Sep. 18, 2003 (DE) ..... 103 43 292

(51) Int. Cl.
*H04R 25/00* (2006.01)

(52) U.S. Cl. ..... 381/324; 381/330

(58) Field of Classification Search ..... 381/322, 381/324, 327, 328, 330, 189, 174, 191, 313; 73/431, 703, 719; 439/67, 492, 493
See application file for complete search history.

(56) References Cited

U.S. PATENT DOCUMENTS 2,634,337 A * 4/1953 Bland ..... 381/322
3,201,528 A * 8/1965 Johanson et al. ..... 381/330
3,458,668 A * 7/1969 Hassler ..... 381/330
4,622,440 A * 11/1986 Slavin ..... 381/330
4,639,556 A * 1/1987 Hartl et al. ..... 381/324
5,048,090 A * 9/1991 Geers ..... 381/323
5,204,917 A * 4/1993 Arndt et al. ..... 381/324
5,407,622 A * 4/1995 Cleveland et al. ..... 264/104
5,757,933 A * 5/1998 Preves et al. ..... 381/328
5,881,159 A * 3/1999 Aceti et al. ..... 381/324
6,088,463 A * 7/2000 Rombach et al. ..... 381/174
6,178,249 B1 1/2001 Hietanen et al.
6,324,907 B1 * 12/2001 Halteren et al. ..... 73/431
6,389,143 B1 * 5/2002 Leedom et al. ..... 381/322
6,456,720 B1 * 9/2002 Brimhall et al. ..... 381/324
6,674,869 B2 * 1/2004 Paczkowski ..... 381/324
2004/0120540 A1 * 6/2004 Mullenborn et al. ..... 381/324

FOREIGN PATENT DOCUMENTS

WO WO 01/60116 A2 8/2001
WO WO 03/049495 A1 6/2003

* cited by examiner

*Primary Examiner*—Daniel Swerdlow

(57) ABSTRACT

The space in hearing device housings (1, 2) is to be enabled to be used more intensively. To this end, the invention pro-poses dispensing with a separate microphone housing and embodying said housing in one piece with the hearing device housing. To reduce the microphone's sensitivity to body sound the corresponding attenuation can be provided in the hearing device shells or the non body-sound-sensitive Silicon microphones (5).

20 Claims, 1 Drawing Sheet

HEARING DEVICE

CROSS REFERENCE TO RELATED APPLICATIONS

This application claims priority to the German application No. 10343292.2, filed Sep. 18, 2003 and which is incorporated by reference herein in its entirety.

FIELD OF INVENTION

The present invention relates to a hearing device with a hearing device housing and a microphone which is accommodated in the hearing device housing.

BACKGROUND OF INVENTION

For cosmetic reasons hearing aids should be worn as invisibly as possible but their microphones must be installed in an ex-posed place in order to pick up sounds. A further criterion governing the placing and accommodation of microphones in a hearing device is the problem of body noise. Since the hearing unit accommodated in the hearing device generates a significant amount of body noise in addition to the air noise that it generates, the microphones must be mounted so that they are isolated from vibration in order to prevent feed-back. A suitable vibration isolation system takes up additional space. The result is that heavy demands are made on the space occupied by the microphone in the hearing device and on its location. The situation is exacerbated by the fact that in modern hearing systems a number of microphones are combined into directional microphone systems in order to suppress interference noise. With directional microphone systems the position of the sound entry holes can no longer be selected at random. In addition the controls of the hearing de-vice, such as push buttons, volume control programming socket etc., have to be arranged on the hearing device housing so that they are ergonomic or practical.

SUMMARY OF INVENTION

Until now commercially available miniature electret micro-phones have usually been used in hearing devices. To prevent feedback, these electret microphones have been mounted in a separate housing isolated from vibration. The above-mentioned general conditions are to be noted for mounting these body sound-sensitive microphones. Geometrical and electro-acoustic requirements often run counter to these conditions.

The article by Weistenhöfer, Ch.; Niederdränk, T. entitled: "Si-Mikrofone in Hörgeräten-Anforderungen und erste Ergebnisse" in Methoden and Werkzeuge zum Entwurf of Mikrosystemen ("SI microphones in hearing devices—Requirements and Initial Results" in Methods and Tools for Developing Microsystems, 9th GMM Workshop 2003, Pages 49 to 52, describes hearing devices with Silicon microphones. This specifically discloses that the sensitivity of Silicon microphones to body noise is lower than that of standard microphones.

An object of the present invention is to take account of the multifarious requirements for the placing of microphones in a hearing device and to propose and optimized hearing device to meet said requirements.

In accordance with the invention this object is achieved by the claims.

By dispensing with a separate microphone housing it is possible to accommodate the microphone in the hearing device in locations at which there would not be sufficient space for a usual microphone with a separate microphone housing. In particular space in the upper part of the hearing device, which has to be designed so that it is especially narrow, can be better utilized by a "housingless" microphone. When conventional microphones are used, for which the housing is square as a rule, there remains unused space in the hearing device since, for cosmetic and ergonomic reasons, the hearing device housing must be round.

A further advantage of the one-piece design of the microphone housing with the hearing device housing is that it allows leads which establish electrical contact from the hearing de-vice housing to the microphone housing to be dispensed with. Instead the electrical connection can be made using MID technology directly on the housing. In this case there is the option of using contact springs to establish direct contact between a microphone chip located on a board and the housing.

Advantageously the microphone is a Silicon microphone. This has the advantage of being much less sensitive to body sound than a conventional microphone such as an electret micro-phone, and is thus of being able to be accommodated without expensive anti-vibration mountings in the hearing device housing.

In the hearing device a cover can be fitted for acoustic separation of the microphone front volume from the remaining interior space of the hearing device housing. This largely avoids feedback from the hearing unit to the microphone.

In the inventive hearing device a number of microphones can be additionally arranged on a shared board in the hearing de-vice housing. The manufacture and installation of a single microphone array basically has advantages over individual microphones.

It can also be advantageous for the microphone or microphones to be arranged on the hearing device board on which the essential components for signal processing of the hearing de-vice are accommodated. This means that the complete electronics of the hearing device can be accommodated on a single board, producing logistical and assembly benefits.

When the hearing device housing consists of a number of parts, the microphone or microphones can also be fixed to one of these parts and most of the other electronic components of the hearing device can be fixed to another part. The advantage of this is that the microphone can be replaced more quickly when service is required.

BRIEF DESCRIPTION OF THE DRAWINGS

The invention will now be explained in more detail on the basis of the enclosed drawings, which show.

DETAILED DESCRIPTION OF INVENTION

The exemplary embodiments described below represent preferred embodiments of the present invention.

Figure 1:
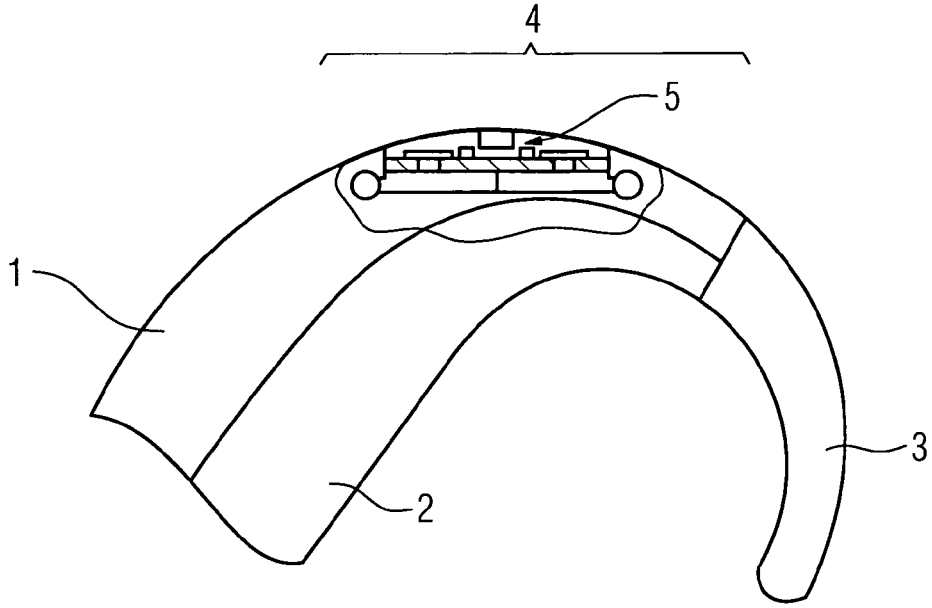
FIG. 1 a part cross-sectional view of a hearing device with two Silicon microphones and FIG. 2 an enlarged cross section from the diagram shown in FIG. 1

A behind-the-ear hearing device is embodied in accordance with the example of FIG. 1 with two Silicon microphones. The hearing device possesses a hearing device housing consisting of an upper housing shell half 1 and a lower housing shell half 2. The two housing shell halves 1 and 2 are tapered to-wards the acoustic output and end in a wearer hook 3. The tapered section of the hearing device housing 1, 2 is too narrow for conventional electret microphones so that this must be arranged at a position in the hearing device which is further away from the wearer hook 3. Opposite this a Silicon microphone 5 without separate microphone housing can also be accommodated in the tapered section 4 of the hearing device housing.

Figure 2:
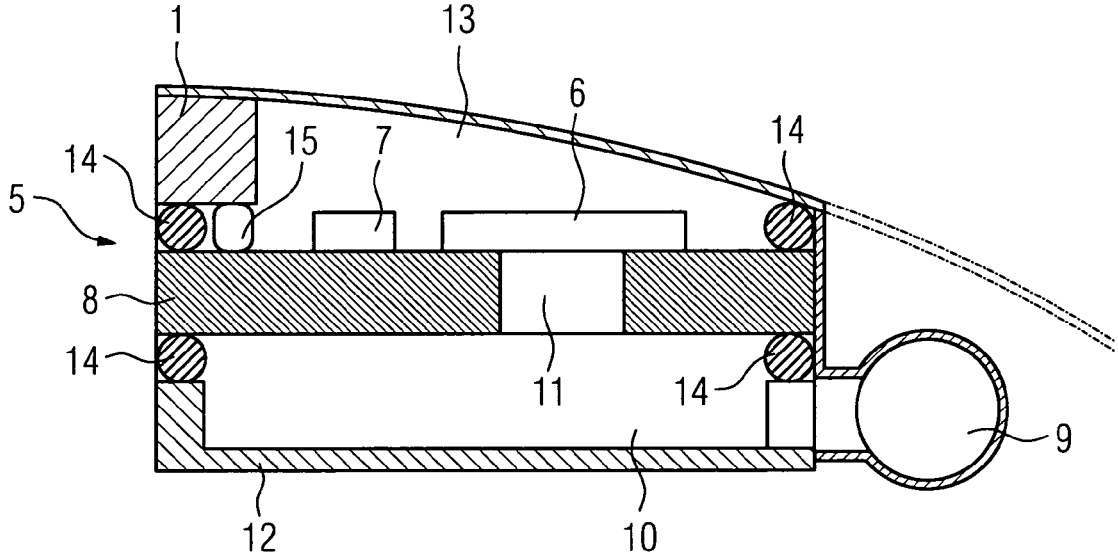

The Silicon microphone is shown in its fitted state in an enlarged view in FIG. 2. It essentially comprises a Silicon microphone chip 6 and a signal processing chip 7 which are both soldered to a circuit board. Board 8 is placed in a suitable cavity of the upper half of the hearing device shell 1. This means that the hearing device housing becomes the microphone housing.

The sound to be received penetrates via a sound entry opening 9 into the hearing device housing in a front volume 10 which is located acoustically in front of the Silicon microphone chip 6. From there it is directed through a hole 11 to the Silicon microphone chip 6.

For acoustic separation of the microphone front volume 10 from the interior of the hearing device housing 1,2 a cover 12 is provided. The acoustic seal between the front volume 10 and the back volume 13 which lies acoustically behind the Silicon microphone chip 6 is made by the rubber seals 14.

The electrical connection of the microphone board 8 to the hearing device housing 1, on which conductor tracks are pro-vided in MID (Molded Interconnected Device) technology, is made via contact springs 15. This allows the Silicon micro-phones 5 to be changed very quickly.

To further reduce the sensitivity to body sound of the Silicon microphones 5 further damping elements not shown in the figure can be used in the hearing device. This allows the transmission of body sound from the hearing device housing to the Silicon microphone board 8 to be restricted.

The invention claimed is:

1. A hearing device, comprising:

a behind-the-ear hearing device housing comprising at least one shell member tapered toward an acoustic output and wearer hook; and a microphone in the hearing device housing spaced apart by a defined distance from a tapered section of a curved interior surface of a first of the at least one shell member, thereby providing a back volume acoustically behind the microphone between the microphone and the tapered section.

2. The hearing device according to claim 1, wherein the microphone is a Silicon microphone, and the back volume so provided is acoustically coupled to the Silicon microphone.

3. The hearing device according to claim 2, further comprising a cover arranged upstream of the microphone in an audio signal direction aiming toward a microphone chip of the microphone, effective to provide acoustic separation of the microphone from other elements of the interior of the hearing device housing.

4. The hearing device according to claim 1, wherein the microphone is positioned on a circuit board electrically connected to the hearing device housing by contact springs.

5. The hearing device according to claim 4, wherein circuit paths formed by MID-technology are arranged on the hearing device housing for contacting the circuit board.

6. The hearing device according to claim 1, wherein a plurality of microphones are arranged on a common circuit board in the hearing device housing.

7. The hearing device according to claim 1, wherein the microphone is arranged on a hearing device circuit board accommodating signal processing components of the hearing device.

8. The hearing device according to claim 1, wherein the hearing device housing comprises the first and a second shell member and the microphone is fixed to the first shell member and the electronic components of the hearing device are fixed to the second shell member.

9. The hearing device according to claim 1, wherein the hearing device housing comprises an upper housing shell half and a lower housing shell half which are tapered towards an acoustic output and end in a wearer hook.

10. The hearing device according to claim 9, wherein the microphone is located in a cavity of the upper housing shell half towards a tapered section.

11. A hearing device, comprising:

a behind-the-ear hearing device housing comprising at least one shell member tapered toward an acoustic output and wearer hook, and comprising a curved interior surface defining a cavity; and a circuit board positioned in the cavity; and a microphone on the circuit board thusly spaced apart by a defined distance from a tapered section of the curved interior surface, thereby defining an adjacent back volume in the cavity between the microphone and the tapered section, wherein the back volume so provided is acoustically coupled to the microphone.

12. The hearing device according to claim 11, wherein the microphone is a Silicon microphone.

13. The hearing device according to claim 12, further comprising a cover arranged upstream of the microphone in an audio signal direction aiming toward a microphone chip of the microphone, effective to provide acoustic separation of the microphone from other elements of the interior of the hearing device housing.

14. The hearing device according to claim 11, wherein the circuit board is electrically connected to the hearing device housing by contact springs.

15. The hearing device according to claim 14, wherein circuit paths formed by MID-technology are arranged on the hearing device housing for contacting the circuit board.

16. The hearing device according to claim 11, wherein a plurality of microphones are arranged on a common circuit board in the hearing device housing.

17. The hearing device according to claim 11, wherein the circuit board is a hearing device circuit board accommodating signal processing components of the hearing device.

18. The hearing device according to claim 11, wherein the hearing device housing comprises the first and a second shell member and the microphone is fixed to the first shell member and the electronic components of the hearing device are fixed to the second shell member.

19. The hearing device according to claim 11, wherein the hearing device housing comprises an upper housing shell half and a lower housing shell half which are tapered towards an acoustic output and end in a wearer hook.

20. The hearing device according to claim 19, wherein the microphone is located in a cavity of the upper housing shell half towards a tapered section.

* * * * *